US005863255A

United States Patent [19]

Mack

[11] Patent Number: 5,863,255

[45] Date of Patent: Jan. 26, 1999

[54] DEVICE AND METHOD TO MEASURE KINEMATICS OF A MOVING GOLF BALL

[76] Inventor: Thomas E Mack, 10592 Wulff Dr., Villa Park, Calif. 92861

[21] Appl. No.: 857,517

[22] Filed: May 16, 1997

Related U.S. Application Data

[60] Provisional application No. 60/027,992 Oct. 9, 1996.

[51] Int. Cl.[6] ..... A63B 69/36

[52] U.S. Cl. ..... 473/152; 473/151; 473/155; 473/197; 473/199; 473/359; 73/12.02; 73/514.39

[58] Field of Search ..... 473/150, 151, 473/152, 155, 156, 172, 197, 199, 200, 359, 360, 409; 73/514.39, 1.39, 1.41, 1.75, 1.79, 11.01, 12.02, 490

[56] References Cited

U.S. PATENT DOCUMENTS

| | | | |
|---|---|---|---|
| 3,160,011 | 12/1964 | Ogden | 473/155 |
| 3,598,976 | 8/1971 | Russell et al. | 473/156 |
| 3,643,959 | 2/1972 | Cornell et al. | 473/152 |
| 3,712,624 | 1/1973 | Conklin | 473/152 |
| 3,759,528 | 9/1973 | Christophers et al. | 473/152 |
| 4,150,825 | 4/1979 | Wilson | 473/152 |
| 4,160,942 | 7/1979 | Lynch et al. | 473/156 |
| 4,177,994 | 12/1979 | Lindquist | 473/156 |
| 4,767,121 | 8/1988 | Tonner | 473/141 |
| 4,858,922 | 8/1989 | Santavaci | 473/197 |
| 5,221,082 | 6/1993 | Curchod | 473/155 |
| 5,226,660 | 7/1993 | Curchod | 473/155 |
| 5,303,924 | 4/1994 | Kluttz et al. | 473/156 |
| 5,333,874 | 8/1994 | Arnold et al. | 473/409 |
| 5,390,927 | 2/1995 | Angelos | 473/155 |
| 5,401,026 | 3/1995 | Eccher et al. | 473/155 |
| 5,437,457 | 8/1995 | Curchod | 473/409 |
| 5,564,698 | 10/1996 | Honey et al. | 473/200 |
| 5,626,526 | 5/1997 | Pao et al. | 473/152 |

*Primary Examiner*—Richard Chilcot
*Assistant Examiner*—Eric S. McCall
*Attorney, Agent, or Firm*—James G. O'Neill

[57] ABSTRACT

A device for measuring the movement of a ball is a flat pad or a frame defining an opening with one or more magnetic field inducing elements mounted thereon. One or more sensor elements are mounted in the flat pad or the frame, and connected to instrumentation so as to record induced, time-varying current signals from disturbances in a magnetic field by the ball penetrating the field. The device may also be arranged so as to measure the spin characteristics and other vectors of a conductive, charged and/or magnetized golf ball penetrating field. Or, the device may be arranged so as to have no magnetic field inducing elements, whereby the magnetic field of a modified, magnetized golf ball, when passing through an opening, or over a flat pad, induces time varying current signals in at least one sensor element, which can be processed to predict the complete ball flight parameters, i.e., velocity, trajectory and spin.

22 Claims, 4 Drawing Sheets

DEVICE AND METHOD TO MEASURE KINEMATICS OF A MOVING GOLF BALL

CROSS REFERENCE TO RELATED APPLICATIONS

This is a continuation application of provisional application Ser. No. 60/027,992, filed on Oct. 9, 1996.

BACKGROUND OF THE INVENTION

1. Field of the Invention

This invention relates generally to means for measuring the flight of a ball, and more particularly, to a device and method for measuring the kinematics of a moving ball, such as a golf ball, and a modified ball for use therewith.

2. Description of Prior Art

Currently, some driving ranges, golf shops, or the like have so called electronic swing analyzers or similar devices which normally use a tarpaulin or other type netting into which a golfer may hit a golf ball to determine where the golf ball might land on a golf course. Such tarpaulins or the like might include a projected golf course or a computer generated image of a golf fairway to produce an image of approximately where the ball would have landed on the course. However, the known devices do not have means to completely and conclusively measure how fast the ball is traveling, its launch angle, the tracking angle or the spin characteristics of the ball. Therefore, there exists a need in the art for a device and method to simultaneously measure all kinematic motion parameters of a ball, such as a golf ball in flight, and which may be used to play a virtual game, such as a game of golf.

SUMMARY OF THE INVENTION

Accordingly, it is a general object of the present invention to provide a device for measuring the flight characteristics of a ball after it has been hit. It is a particular object of the present invention to provide a ball movement measuring instrument. It is a still more particular object of the present invention to provide a device having sensor means therein to measure the kinematics of a ball traveling through the device. It is yet another object of the present invention to provide a method of measuring the movement of a ball after it has been struck. It is yet a further object of the present invention to provide a magnetic measuring device for determining the movement of a modified ball, such as a golf ball, after impact. It is yet another particular object of the present invention to provide a method of more positively custom fitting a striking means, such as a bat or a golf club to a user by measuring the movement of a traveling ball by means of inducing disturbances in a magnetically generated field. It is a still further object of the present invention to provide a system which may be used to project the movement of a struck ball, such as a golf ball, to enable a user to trace the flight of the ball, and/or play a virtual game.

In accordance with one aspect of the present invention, there is provided a means for generating a magnetic field for measuring the motion characteristics of a ball passing through the field. The magnetic field may be generated by means of a flat pad or a frame having a vertical opening placed in front of a person striking or throwing a ball. The pad or frame includes a sensor means connected to instrumentation to record disturbances to the magnetic field by a ball traveling through the magnetic field. A modified ball, such as a golf ball, with an internal magnet or provided with a conductive coating, which coating may be charged or magnetized. The disturbances in the generated field from such a modified ball passing through the field are recorded by the connected instrumentation and processed by a computer or the like to measure various translation and rotation vectors of the traveling ball, and may be projected on a video display to depict the ball flight and final roll out. A method is provided for calculating the full three dimensional movement (translation and rotation) of a modified ball, such as a golf ball, passing through the generated magnetic field and/or to depict the ball flight and final roll out, after impact by a striking means, such as a golf club.

BRIEF DESCRIPTION OF THE DRAWINGS

The objects and features of the present invention, which are believed to be novel, are set forth with particularity in the appended claims. The present invention, both as to its organization and manner of operation, together with further objectives and advantages, may be best understood by reference to the following description, taken in conjunction with the accompanying drawings, in which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for means for measuring the velocity and other vector components of a traveling ball.

Figure 1:
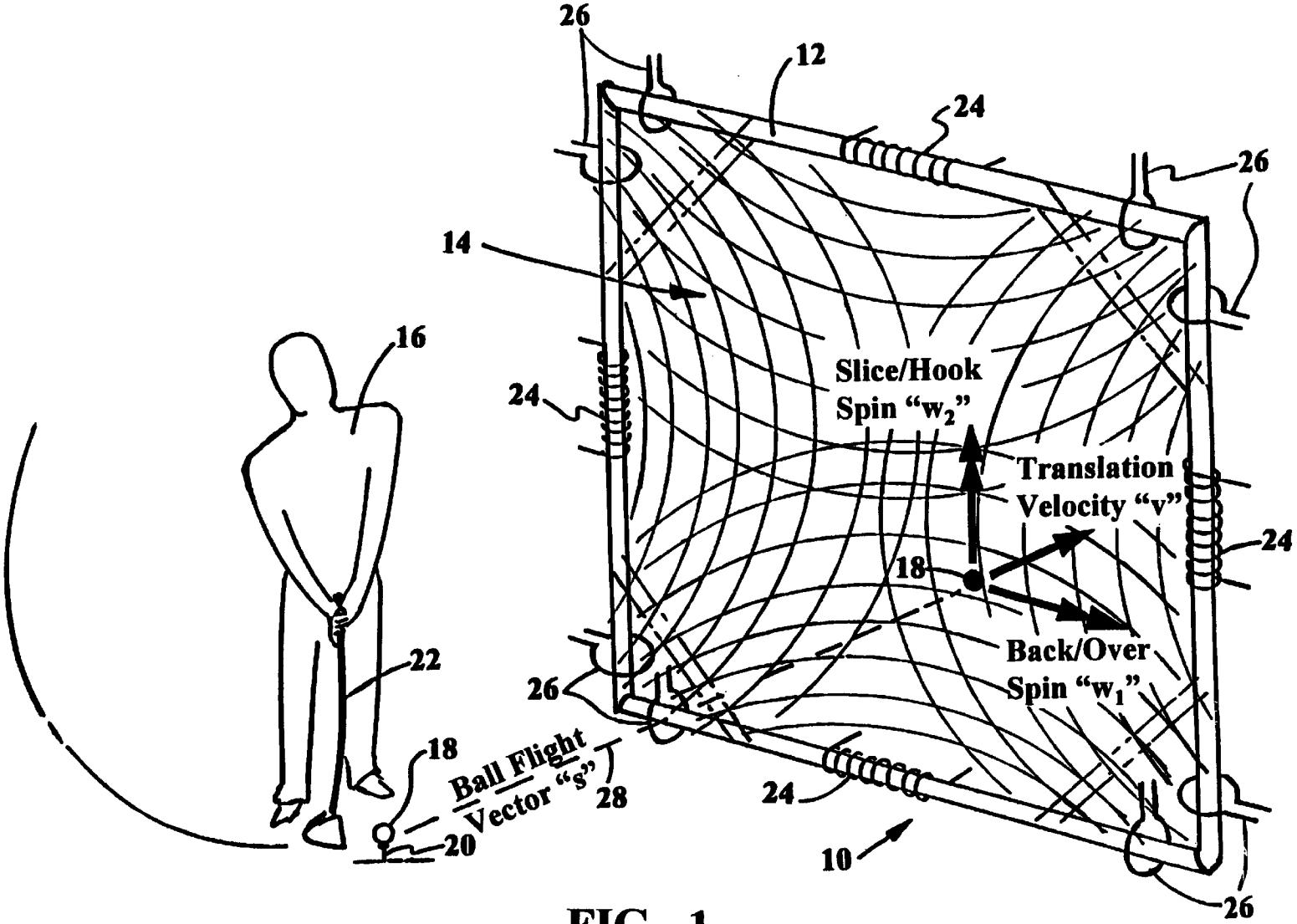
FIG. 1 is an isometric view of a first embodiment of a test stand frame of the present invention with a golfer standing in front of the same to drive a golf ball through the frame for measuring impact data of the driven golf ball.

Turning now to the drawings, the invention is described in connection with the measurement of the flight of a golf ball after being struck by a club, but is applicable to the flight of any type of a ball, such as a baseball, after it is struck by a bat or thrown. Modifications to the ball may be required to increase its conductivity and/or to charge and/or magnetize the ball. FIG. 1 illustrates a first embodiment of the invention, generally indicated at 10. This first embodiment includes a frame or the like 12 which may be of any desired shape and made from any desired material, but which, in the embodiment shown, defines an eight foot by eight foot vertical opening 14 through which a golfer, indicated at 16, may drive a golf ball 18 mounted on a tee 20, by rotation of a club 22, in a known manner. In the embodiment shown in FIG. 1, the frame 12 has a plurality of magnetic field generating means 24, such as four (4) solenoid coils mounted on the frame, substantially at the midpoint of each side edge of the opening 14. The field generating means 24, when activated will produce a magnetic field within the opening 14. A plurality of sensor means 26, are placed around the frame 12, preferably as sensor pairs at the four (4) corners of the frame around the opening 14. The sensor means 26 are in turn hooked to instrumentation, such as a computer, to record induced time varying current signals from disturbances to the magnetic field by a ball 18 passing therethrough. That is, the sensor means 26 are used to measure and record induced time varying current signals from disturbances to the magnetic field by the golf ball passing through the opening 14. For example, when the ball 18 is hit by a club 22, it will travel in a straight line indicated by broken line 28, i.e., along ball flight vector "S". When the ball 18 penetrates the magnetic field induced in the opening 14, the device of the present invention measures a number of vectors, such as a slice or hook spin "$w_2$ " translation velocity "v", and backspin or overspin "$w_1$".

The ball 18 may be modified, for example, so as to be conductive, charged and/or magnetized when penetrating the magnetic field within the opening 14. If the modified ball is conductively coated, charged, and/or magnetized, a second embodiment of the present invention, having no field generating means such as 24, would be utilized. In this second embodiment, the sensing means 26 would then measure time varying current signals induced by the modified ball's magnetic field disturbance as it passes through the opening 14.

Figure 2:
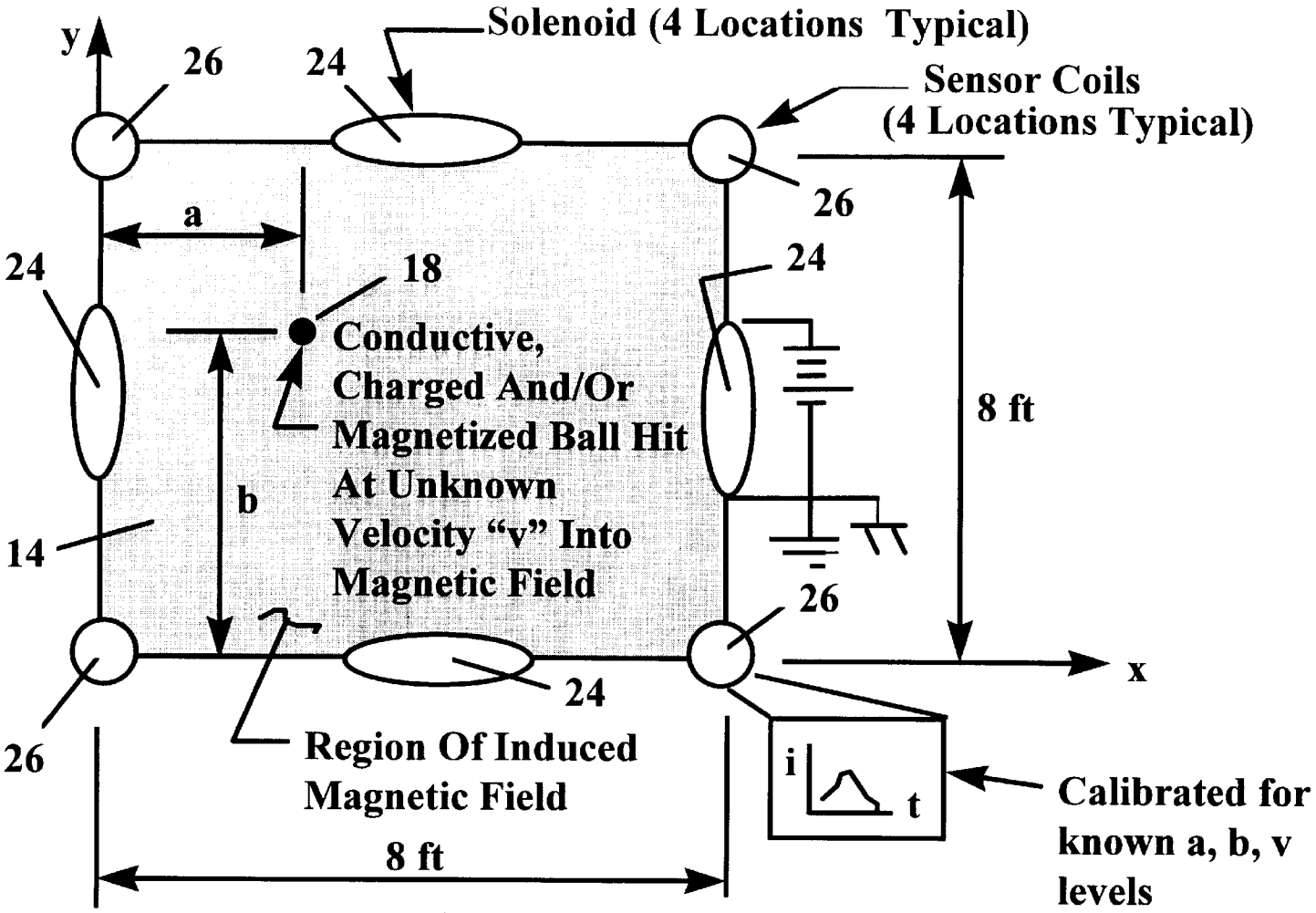
FIG. 2 is a schematic view of the test stand frame of FIG. 1.

FIG. 2 is a schematic diagram of the embodiments described above, that utilize the magnetic field generating solenoids 24 illustrating one embodiment of the method of the present invention. The solenoid coils 24 induce an AC or DC magnetic field opening 14, and the sensor means 26 are connected to an instrument, such as a computer, where the time varying induced current signals by a golf ball passing through opening 14 may be compared to calibrated signal levels or simulated mathematically. That is, by using calibrated signal levels or simulation algorithms contained in the computer, the velocity "v" may be measured, as well as the golf ball tragectory and spin vectors. When using a modified ball that is conductively coated, charged and/or magnetized, no solenoid coils 24 are required.

The modified golf ball used, of whatever type, is preferentially oriented during calibration procedures. The recorded calibration data is programmed into the computer and may be obtained by measuring the time varying current signals induced in the sensor means 26 when golf balls are driven through the opening 14, at known velocities and into known grid locations within the opening. These recorded current signals for each sensor means 26 are then recorded in the data base within the computer and used as a calibration lookup tabular field when random shots pass through the opening and a golf ball's penetration vector position and velocity must be determined.

As discussed above, if the magnetic field generating solenoid coils 24 are not used, a modified golf ball of a magnetized type is used and is preferentially oriented in its initial position on the tee 20 before it is hit by rotation of a club 22. When this magnetized, modified golf ball is driven through the opening 14, at unknown velocity, trajectory and spin rates, time varying current signals induced in one or more sensor means 26 by the magnetic field of the modified ball, are measured and processed in a computer. The ball flight parameters (trajectory, velocity and spin) are evaluated, i.e., the actual measured test signals can be displayed or used in conjunction with predicting the ball's complete flight and final roll-out.

Figure 3:
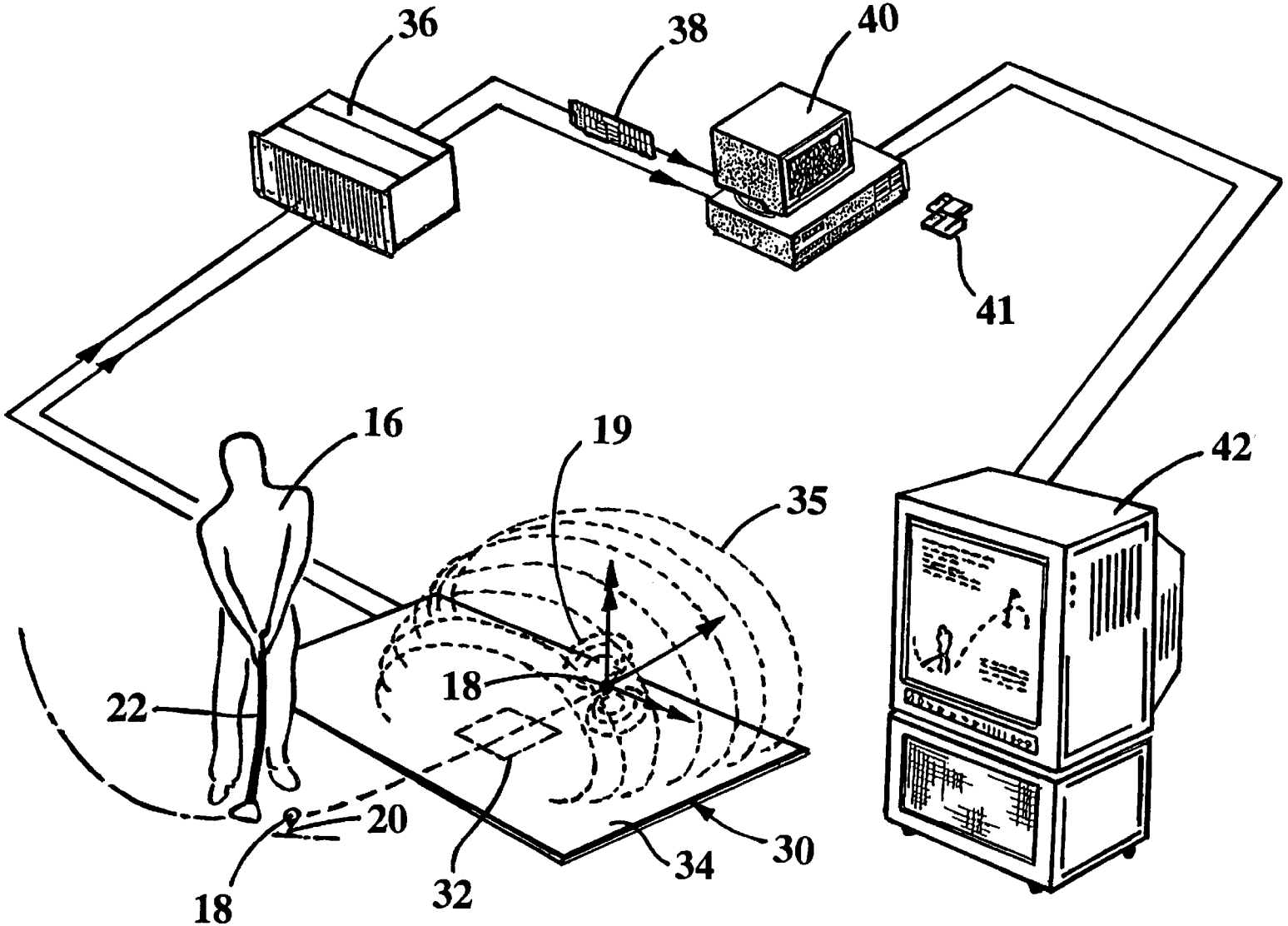
FIG. 3 is a schematic view of a second embodiment of the invention comprised of a flat pad having magnetic field generating means therein connected to instrumentation, and a video display unit.

Turning now to FIG. 3, there shown is a second embodiment of the invention comprising a substantially flat pad 30, which may be of any desired shape, and made of any desired material having magnetic field sensing means 32, such as one or more fluxgates held therein. A currently used fluxgate is a No. 560, 3 axis fluxgate, manufactured by Applied Physics Systems, Inc., of San Jose, Calif. The flat pad has a top side 34 and a lower side which is mounted on a flat surface directly in front of, or spaced a predetermined distance from the golfer 16. The golfer may drive the modified ball 18, mounted on the tee 20, over the top surface 34 of the pad by impacting the ball on rotation of the club 22.

Known means may be connected in the vicinity of the fluxgate means 32, to generate a magnetic field 35, above the pad 30. As is well known to those skilled in the art, the fluxgate 32 includes sensor means incorporated therein. This sensor means is capable of recording the disturbances in the generated field 35 as a modified golf ball passes through this field. As discussed previously, if a magnetic field is not generated, a modified golf ball of a magnetized type is used and is preferably oriented in its initial position on the tee 20 before it is hit by rotation of club 22. When this magnetized modified golf ball is driven over the fluxgate 32 sensor or sensors, at unknown velocity, trajectory and spin rates, time varying current signals, induced within the fluxgate sensor or sensors by the magnetic field 19 of the modified ball, are measured and processed in a computer. The sensor means are in turn hooked up to instrumentation, such as a signal conditioning means 36, data acquisition and analysis hardware means 38, and a computer 40, such as a PC having proprietary software algorithms 41 therein. The computer 40 and proprietary algorithms 41 measure and record the disturbances caused by the modified golf ball passing over the pad and through the magnetic field 35, to determine the flight and other vectors of the ball, as described above. As discussed previously, if no magnetic field 35 is generated, a modified golf ball of a magnetic type is driven over the fluxgate 32 sensor or sensors, which will cause recorded disturbances resulting from the modified ball's magnetic field motions (both translation and rotation). The computer 40 may be in turn connected to a video display 42 of any size or structure, such as a surrounding room, to display the processed data as a depiction of the ball flight and final roll out, and/or to enable a player to experience a "virtual golf game".

Figure 5:
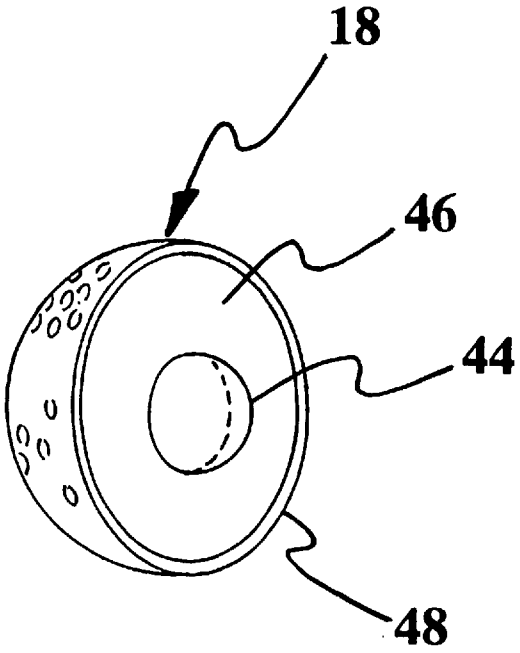
FIG. 5 is a cross-sectional isometric view of the golf ball of FIG. 4, taken along line 5–5.
Figure 4:
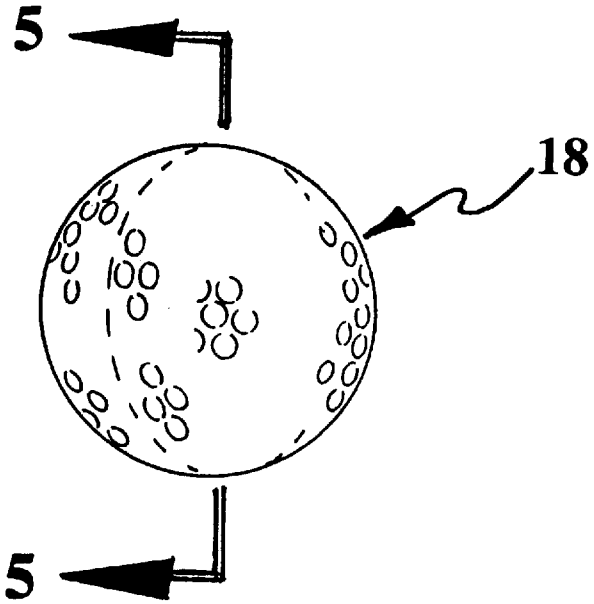
FIG. 4 is an elevational view of a preferred embodiment of a modified golf ball of the present invention.

As shown more clearly in FIGS. 4 and 5, a modified golf ball 18 is used with the various embodiments of the present invention. The modified golf ball 18 in one of its current manufactured configurations includes a core magnet 44, such as a spherical ceramic magnet, held in the center of an elastomeric material 46. A ball cover 48, made from Suryln, or the like, is then formed around the elastomeric material. The ball 18, with its core magnet 44 will produce a magnetic field, such as shown at 19 in FIG. 3, and when the modified ball is driven through the magnetic field generated in the vicinity of the fluxgate 32, the magnetic field 19 of the modified ball will cut the generated magnetic field and allow vector measurements of the flight of the ball to be made, in accordance with the invention. Again, if a generated magnetic field is not used, the motion of the modified ball's magnetic field passing over the fluxgate sensor or sensors, will provide sufficient time varying current signals for the measurement of ball flight parameters.

It, therefore, can be seen that the device and method of the present invention provide novel and unique means for measuring the trajectory, velocity and spin rate of a modified ball passing through an instrumented opening with or without a solenoid generated magnetic field, so as to accurately track how a struck or thrown ball would travel, including where it would land, and how far it might roll. Additionally, the unique modified ball of the present invention allows the device and method of the present invention to be more easily used, and to enhance their performance.

Those skilled in the art will appreciate that various adaptations and modifications of the just described preferred embodiments can be configured without departing from the scope and spirit of the invention. Therefore, it is to be understood that, within the scope of the appended claims, the invention may be practiced other than as specifically described herein.

What is claimed is:

1. A device for measuring and predicting spin and trajectory vectors of a moving ball, comprising:

at least one means for generating a magnetic field;

a conductive, charged and/or magnetized modified ball;

means for holding the at least one means for generating a magnetic field;

at least one means for sensing electromotive force induced signals resulting from disturbances in the magnetic field by passage of the conductive, charged and/or magnetized modified ball through the generated magnetic field; and means for processing the electromotive force induced signals resulting from disturbances in the magnetic field to thereby predict the complete flight and final roll-out of the conductive, charged and/or magnetized modified ball.

2. The device of claim 1 wherein the means for holding the at least one means for generating a magnetic field is a flat pad having a top surface over which the moving conductive, charged and/or magnetized modified ball travels.

3. The device of claim 2 wherein the at least one means for sensing electromotive force induced signals resulting from disturbances in the magnetic field is a fluxgate.

4. The device of claim 3 wherein the moving conductive, charged and/or magnetized modified ball is a golf ball.

5. The device of claim 4 wherein the golf ball has a single magnet therein.

6. The device of claim 5 wherein the single magnet is a spherical central magnet.

7. The device of claim 4 wherein the golf ball is conductively coated so as to be charged and/or magnetized.

8. The device of claim 1 wherein the means for holding the at least one means for generating a magnetic field is a frame defining a vertical opening, and the moving conductive, charged and/or magnetized modified ball travels through the vertical opening.

9. The device of claim 8 wherein the at least one means for generating a magnetic field is a solenoid coil mounted to the vertical frame.

10. The device of claim 8 wherein the at least one means for sensing disturbances in the magnetic field is a sensor mounted on the vertical frame.

11. The device of claim 8 wherein the conductive, charged and/or magnetized modified ball is a golf ball.

12. The device of claim 11 wherein the golf ball is conductively coated.

13. A measuring device for predicting spin and trajectory vectors of a moving ball comprising:

a conductive, charged and/or magnetized modified ball;

a frame defining a vertical opening through which the conductive, charged and/or magnetized modified ball travels;

at least one sensor means placed on the frame around the vertical opening so as to sense electromotive force induced signals resulting from disturbances caused by the conductive, charged and/or magnetized modified ball passing through the opening; and means for processing the electromotive force induced signals resulting from disturbances caused by the conductive, charged and/or magnetized modified ball passing through the opening to thereby predict the complete flight and final roll-out of the conductive, charged and/or magnetized modified ball.

14. The device of claim 13 wherein the conductive, charged and/or magnetized modified ball is a golf ball.

15. A device for measuring velocity, direction of travel and spin rate of a moving ball comprising:

a ball modified to be conductive, charged and/or magnetized;

a flat pad having an upper surface and a lower surface;

at least one magnetic field generating means held in the pad;

at least one sensor means cooperating with the at least one magnetic field generating means in the pad;

means connected to the at least one sensor means to record electromotive force induced signals caused by disturbances of the moving ball modified to be conductive, charged and/or magnetized passing through a magnetic field formed over the upper surface of the pad;

means for processing the recorded electromotive force induced signals; and means for measuring the velocity, direction of travel and spin rates of the ball passing through a magnetic field formed over the upper surface of the pad.

16. The device of claim 15 wherein the moving ball modified to be conductive, charged and/or magnetized is a golf ball.

17. The device of claim 16 wherein the golf ball is conductively coated so as to be charged and/or magnetized.

18. A device for determining velocity, direction of travel and spin rates of a moving ball, comprising:

a conductive, charged and/or magnetized modified ball;

at least one sensor for sensing electromotive force induced signals resulting from disturbances caused by passage of the conductive, charged and/or magnetized modified ball through a magnetic field;

a support for the at least one sensor;

a computer for processing the electromotive force induced signals resulting from disturbances cause by passage of the conductive, charged and/or magnetized modified ball through a magnetic field ; and means for displaying the complete flight and final roll out of the conductive, charged and/or magnetized modified ball.

19. The device of claim 18, further including a vertical frame and wherein there are a plurality of sensors mounted around the vertical frame.

20. The device of claim 19, further including a plurality of solenoid coils mounted around the vertical frame for generating a magnetic field.

21. The device of claim 18 wherein the means for supporting the at least one sensor is a flat pad, and the at least one sensor is a fluxgate.

22. The device of claim 21, further including at least one magnetic field generating means mounted adjacent the fluxgate in the flat pad.

* * * * *